US005149282A

United States Patent [19]

Donato et al.

[11] Patent Number: 5,149,282

[45] Date of Patent: Sep. 22, 1992

[54] MODULAR STEM SYSTEM FOR LIGHTING APPLICATIONS

[75] Inventors: Anthony C. Donato, Westfield; Albert L. Newman, West Orange, both of N.J.; Alejandro Mier-Langner, Brooklyn, N.Y.

[73] Assignee: Lightolier Division of The Genlyte Group, Inc., Secaucus, N.J.

[21] Appl. No.: 844,997

[22] Filed: Mar. 2, 1992

Related U.S. Application Data

[63] Continuation of Ser. No. 744,674, Aug. 9, 1991, abandoned, which is a continuation of Ser. No. 575,231, Aug. 30, 1990, abandoned.

[51] Int. Cl.[5] ..... H01R 13/73

[52] U.S. Cl. ..... 439/530; 439/534; 439/542; 248/160; 403/229

[58] Field of Search ..... 248/160, 324; 362/404, 362/431; 403/2, 229, 291; 439/162, 164, 527, 529, 530, 534, 542, 543

[56] References Cited

U.S. PATENT DOCUMENTS

| | | | |
|---|---|---|---|
| 985,241 | 2/1911 | Anderson | 439/142 |
| 1,279,803 | 9/1918 | Watson | 248/160 |
| 1,456,194 | 5/1923 | Rosenberg | 362/388 |
| 1,994,886 | 3/1935 | Doane | 439/162 |
| 2,094,475 | 9/1937 | Schwarzhaupt | 248/160 |
| 2,691,770 | 10/1954 | Jonaitis | 439/668 |
| 2,877,437 | 3/1959 | Flanagan | 439/353 |
| 3,051,925 | 8/1962 | Felts | 439/357 |
| 3,437,059 | 4/1969 | Stonier et al. | 403/229 |
| 4,227,424 | 10/1980 | Schleappe | 403/229 |
| 4,352,327 | 10/1982 | Sleep | 403/229 |
| 4,431,254 | 2/1984 | Cartesse | 439/610 |
| 5,029,783 | 7/1991 | Alvarez | 248/160 |
| 5,067,906 | 11/1991 | Woodgate | 439/530 |

FOREIGN PATENT DOCUMENTS

| | | | |
|---|---|---|---|
| 658267 | 2/1963 | Canada | 248/160 |
| 1215214 | 4/1960 | France . | |
| 617407 | 2/1949 | United Kingdom | 403/229 |

*Primary Examiner*—Gary F. Paumen

*Attorney, Agent, or Firm*—Hopgood, Calimafde, Kalil Blaustein & Judlowe

[57] ABSTRACT

A specific, illustrative modular stem system for lighting apparatus comprising hollow stems, each having first and second ends; a connector plug mounted at the first end; an in-line connector mounted inside the stem adjacent to the second end, the connector being configured for receiving the plug of another stem so as to permit connection of the stems end to end; a flexible joint so as to permit flexure of the stem upon the application of lateral forces to the stem system, means for dually securing the connector to the stem and the plug to the connector so as to facilitate connection of the stems end to end; and a lamp adjacent to the second end of the lowermost stem.

9 Claims, 2 Drawing Sheets

MODULAR STEM SYSTEM FOR LIGHTING APPLICATIONS

This application is a continuation of application Ser. No. 744,674, filed Aug. 9, 1991, now abandoned, which is a continuation of application Ser. No. 575,231, filed Aug. 30, 1990, now abandoned.

DISCLOSURE OF THE INVENTION

The invention relates to components for electrical apparatus and, more specifically, to stem structures for lighting applications.

Practicality dictates that lighting equipment be positioned so as to accommodate selected lighting requirements. For example, it is desirable that ceiling mounted display lighting be placed as close as possible to the thing being illuminated. Such lighting equipment must also be capable of absorbing the shock of bumps and other forces experienced during normal use while providing adequate protection to electrical wiring housed therein. It is further desirable to change the style and design of lighting elements without replacement of the entire lighting system. In addition, it is desireable that the equipment have an aesthetically pleasing appearance.

Conventional ceiling mounted display lighting comprises a long hollow shaft having an upper end and a lower end. The upper end is adapted for mounting to the ceiling and the lower end is adapted for mounting a lamp. The height of the ceiling and other characteristics of the setting dictate the necessary length of the shaft.

It has been found, however, that the conventional one piece shaft assembly must be custom fit to the particular setting and lighting application. Accordingly, its adaptation to other settings, e.g., higher ceilings, is often an impossibility.

In addition, if a lateral force is applied distally to the fixed ceiling mount, a substantial bending moment about the mount (due to the long shaft) is created which may cause breakage of the shaft from the fixed mount. Should this occur, electrical wires may be exposed resulting in a fire or electrical hazard. Furthermore, it has been found costly to replace such equipment due to breakage or the need for a new shaft custom fit to each use.

Thus, it is an object of the present invention to provide a safe, durable, economical, and cosmetically appealing modular stem system and method for making the same which is versatile, easy to assemble, lightweight and reliable.

The above and other objects of the present invention are realized in a specific, illustrative modular stem system for lighting apparatus, comprising at least a pair of stems, each having a first end configured for cooperation with a second end of another stem, a plug for engaging the second end of another stem, an in-line connector housed in the first end for receiving the plug of the other stem so as to allow connection of the stems end to end, and a flexible joint for absorbing forces applied to the stem system.

The above and other features and advantages of the present invention are realized in specific, illustrative embodiments thereof, presented hereinbelow in conjunction with the accompanying drawings, in which.

Figure 1:
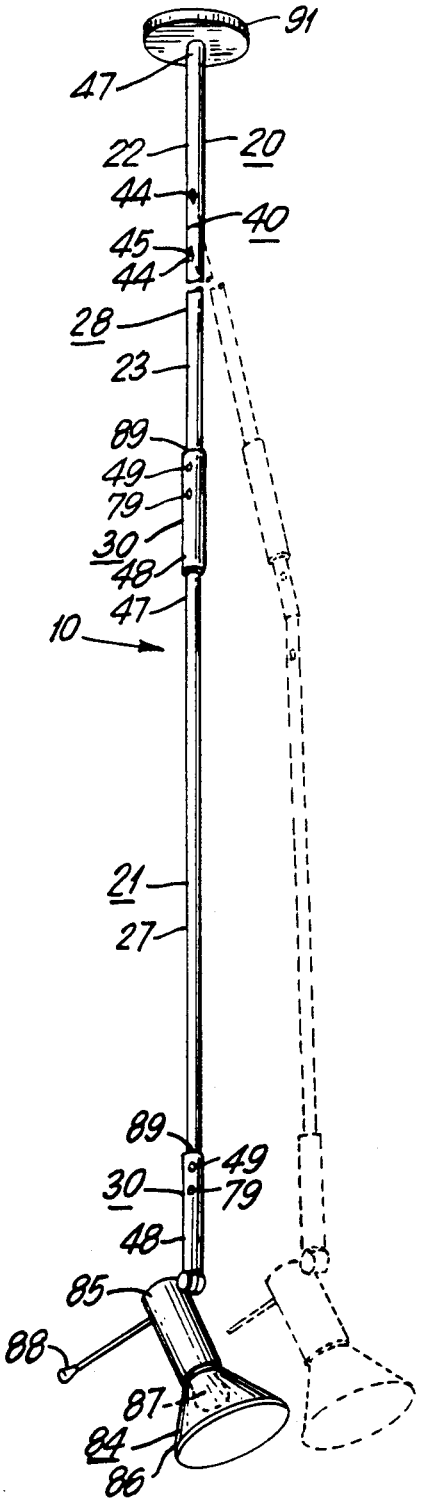
FIG. 1 is a perspective view of the modular stem system of the present invention.

Referring now to the drawings and more particularly to FIG. 1, there is shown generally a modular stem system for lighting apparatus 10 in accordance with the present invention, comprising a pair of slender stem modules 20, 21 connected end to end by a plug and in-line connector assembly 30, at least one module having a flexible joint assembly 40 for absorbing lateral forces applied to the stem system.

As shown in FIGS. 1–4, each stem module comprises at least upper and lower tubular members 22, 23, each end 26 configured for cooperation with an opposite end 28 of another member. When the respective ends 26, 28 are aligned and placed in contact with one another, a hollow passageway 29 is formed across the member interiors. This passageway is suitable for containment of electrical wiring or the like.

The upper and lower members are movably joined at their cooperating ends by flexible joint assembly 40. Assembly 40 comprises a coil spring 41 with hooks 42 at each end. The spring is mounted across the aligned, end to end cooperating members 22, 23. Each hook cooperates with a perforation 43 in each member so as to secure the spring across the member joint. The perforations are located a selected distance, for example, 2 inches, from the cooperating ends of each member.

Each perforation has a lengthwise extending recessed portion 44 formed in the exterior surface of the member for receiving hook outer ends 45 so as to maintain the hooks generally coplanar with the member outer surface. When assembled, the hooks and the recessed portions are aligned with one another.

The recessed portions prevent the hooks from catching on articles of clothing during manufacture, being damaged or becoming disengaged from the members. This configuration also maintains the aesthetically pleasing appearance of the stem.

Figure 2:
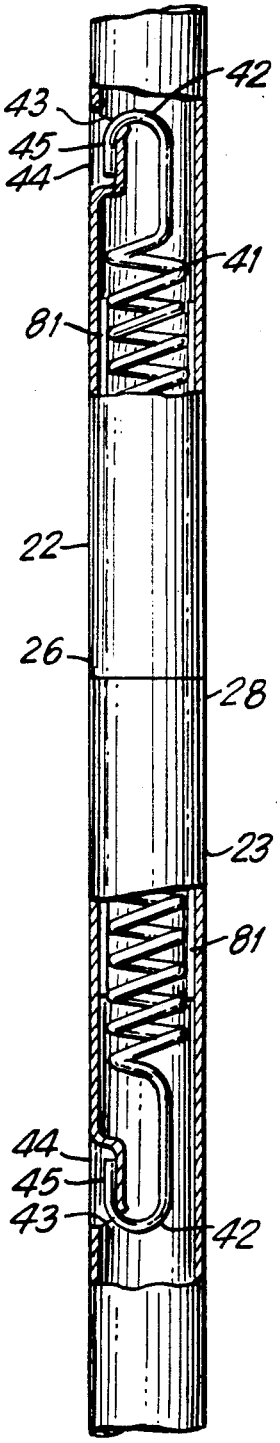
FIG. 2 is a cut-away plan view of a flexible joint assembly for the present invention.
Figure 3:
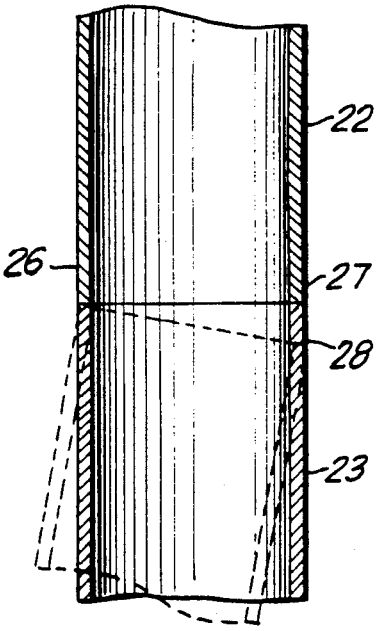
FIG. 3 is a cut-away view of FIG. 2 showing bending of tubular members about the joint.

As best seen in FIG. 2, a flexible sleeve 81 lines the tubular members and extends across their corresponding ends so as to house and protect the spring and wires housed therein. The sleeve may be constructed of any suitable flexible material such as plastic, rubber or the like.

Figure 4:
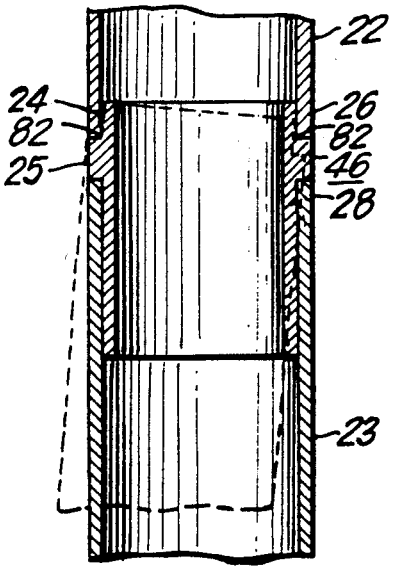
FIG. 4 shows an alternative embodiment of the assembly of FIG. 3.

In an alternative embodiment of the present invention, a flanged sleeve 46 (shown in FIG. 4) lines the tubular members and extends across their corresponding ends so as to house the spring, align the tubular members, and protect the ends thereof. Sleeve 46 has an extension 24 and a flange 25 which extend from the upper end 28 of one member 23, the flange defining a circumferential shoulder 82. The lower end 26 of the other member 22 is configured for receiving extension 24 and shoulder 82 so as to allow pivotal movement about the flange between aligned and flexed positions, as shown in FIG. 4. The sleeve may be constructed of any suitable material, preferably a rigid material such as metal, plastic or the like.

In operation, each member is initially aligned with the other in a linear fashion. Upon the application of lateral forces, e.g., if the stem system is bumped during installation or cleaning, the spring allows the members to pivot about their cooperating ends. Upon pivotal movement, an obtuse angle, for example, is formed between the members. Upon release of the force, the spring returns the members to their initial aligned orientation. In this manner, the members may repeatedly bend and then return to their original position. This, in turn, permits shock absorption during normal use while providing a protective housing for electrical wiring passing through the members.

The flexible joint is advantageous in allowing shock absorption in any lateral direction. Therefore, should lateral forces be applied at locations along the modular stem system distal to a ceiling mount 91, breakage of the stem from the ceiling mount and/or other damage to the stem system is prevented.

Preferably, a single flexible joint is located proximate to member upper end 28 of the top module of the system. This configuration provides flexibility to the stem system adjacent to the portion which experiences the maximum bending moment, i.e., where upper end 28 is affixed to the ceiling mount 91. Although the present invention has been described as having only one flexible joint equipped module per stem system, it is understood that any number of flexible joint equipped modules, e.g., two, as shown in dashed lines in FIG. 1, or, alternatively, any number of flexible joints per module, could be utilized giving consideration to the purpose for which the present invention is intended.

Each stem module is tubular in shape and has upper and lower ends 47, 48. Ends 47, 48 preferably have different diameters, the plug receiving first or upper end having a relatively smaller diameter and the connector receiving second or lower end having a relatively larger diameter. This permits the upper end of one module to fit inside the lower end of another module so as to permit engagement of the plug with the connector and connection of stem modules end to end. In this manner, any number of suitably dimensioned stems could be connected depending upon the setting and desired lighting requirements. However, it is desirable that the difference in diameters between the upper and lower stem ends not be such as to diminish the aesthetically pleasing appearance of the assembled stem system.

Accordingly, each stem module preferably has a slender profile so as to maintain an aesthetically pleasing, unobtrusive appearance.

As for the length of the stem modules, it is dependent upon the particular lighting requirements including the ceiling height. For example, it has been found that a pair of 21 inch stem modules are suitable for an 8 foot ceiling.

Figure 5:
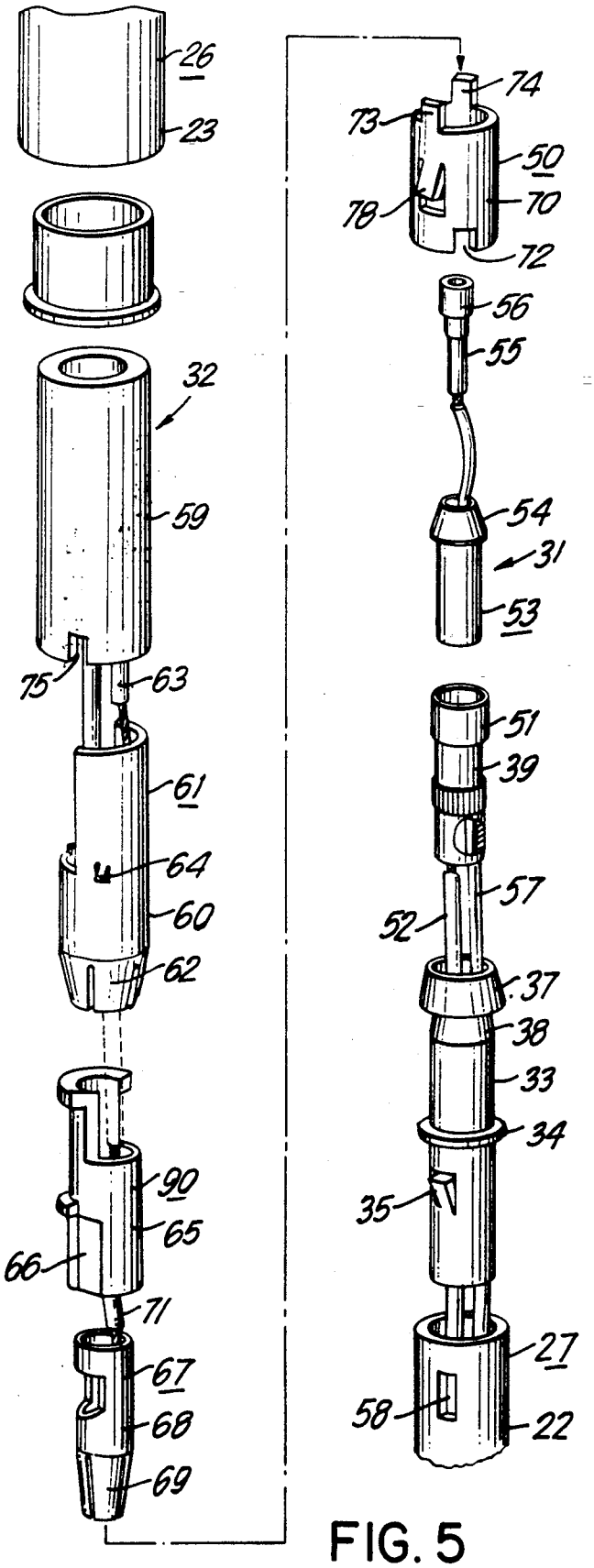
FIG. 5 is an exploded view of an in-line connector and plug assembly for the present invention.
Figure 6:
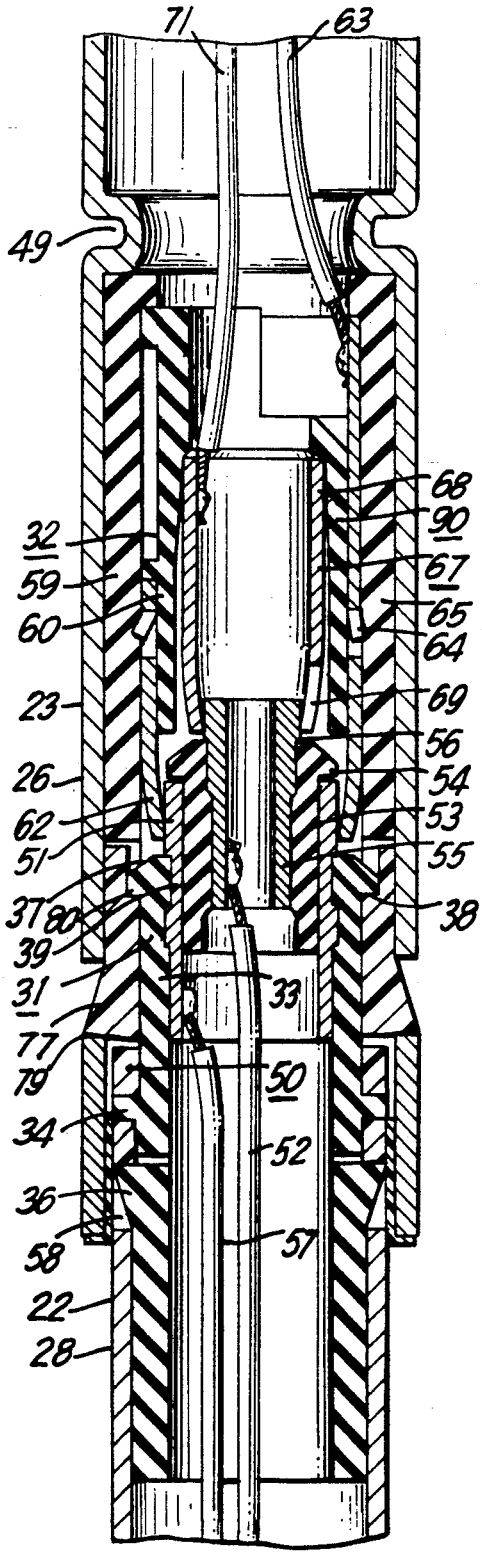
FIG. 6 is a sectional view of the in-line connector and plug assembly of FIG. 5, assembled.

Referring now to FIGS. 5 and 6, the upper end of the module mounts a plug 31 and the lower end receives an in-line connector 32. Upon insertion of the upper end of one module into the lower end of another, the in-line connector in one stem module receives and engages the plug of the other module so as to allow connection of the modules end to end. Hence, a modular stem system is formed.

The plug is securely mounted to the module upper end, e.g., by a press fit with the stem interior. The connector, on the other hand, is mounted inside the module lower end. First, the connector is inserted into the lower end of a module. Next, it is slidably displaced along the module interior until it abuts a stop 49. The stop is located between the module lower end and a point 89 along lower tubular member 23 where the diameter of the module changes. Preferably, the stop is positioned just below the point of diameter change to provide a sufficient depth for insertion of lower tubular member 23 into upper tubular member 22. This depth provides strength at the joints between stems of the system. The connector is then snapped securely inside the stem using a clip 50.

Plug assembly 31 comprises a hollow, cylindrical insulator housing 33 with a collar 34 formed at its midsection, a pair of radial snap fit extensions 35, 36 on opposing sides of its lower portion, and a tapered collar 37 adjacent to its upper end. The tapered collar has an adjacent sloped portion 38 which, upon cooperation with the in-line connector, forms a catch to engage clip 50 and hold the plug and connector together.

A conductor tube 39 having a contact collar 51 at its upper end is secured inside the housing such that its collar extends beyond tapered collar 37 of the housing. A first wire 52 is secured to the inside of the tube so as to provide an electrical contact for cooperation with the in-line connector.

Next, an insulator tube 53 having a tapered collar 54 at its upper end is secured inside conductor tube 39 such that its tapered collar extends beyond contact collar 51.

Finally, a conductor tube extension 55 having a collar 56 at its upper end is secured inside insulator tube 53 such that its collar also extends beyond tapered collar 54. A second wire 57 is secured to the lower end of the extension so as to provide a second electrical contact for cooperation with the in-line connector.

The tubes and extensions are secured to one another by any suitable means, e.g., press fitting one tube or extension inside the other. The housing and insulator tube are constructed preferably of an electrically insulating material, e.g., plastic or the like. The conductor tube and extension, on the other hand, are preferably constructed of a suitable electrically conductive material such as metal or the like.

Each upper tubular member 22 has a pair of perforations 58 adjacent its upper end which are configured for engagement with radial extensions 35, 36 on the housing lower portion. Upon placing the housing in member 22 and aligning the extensions with the perforations, the extensions snap into the perforations so as to secure plug assembly 31 to the member.

In-line connector assembly 32 comprises a hollow, cylindrical insulative body 59 with a series of inserts. A first insert 60 comprises a hollow cylindrical conductive member 61, one side being sectioned in half from its midsection to one end. The opposite end is formed of four contact prongs 62. Interior surfaces of the prongs engage the exterior of contact collar 51 upon engagement of the plug with the connector. A third wire 63 is mounted to the member interior so as to facilitate an electrical connection between the contact prongs and collar.

Preferably, the first insert also has radially extending prongs 64, e.g., three. Upon insertion of the first insert into the connector body, the prongs firmly engage the connector body interior so as to secure the first insert therein. However, it is understood that any suitable means could be utilized to secure the first insert in conductive member 61.

A second insert 90 also comprises a hollow insulative cylindrical member 65. One side of the member is sectioned in half from its midsection to one end and has a diameter allowing it to fit inside the first insert. As best seen in FIG. 5, the second insert preferably fits loosely inside the first insert and is oriented such the respective sectioned and unsectioned sides of the first and second inserts face one another. The unsectioned half of the second insert member has a pair of opposing flattened edges 66 for engaging the first insert.

A third insert 67 comprises a hollow cylindrical conductive member 68 sectioned along one edge midway along its length. Its diameter is relatively less than that of the second insert so as to permit its placement therein.

The end opposite to that first inserted in the second insert is formed of four contact prongs 69. The third insert is secured in the second by any suitable means, e.g., press fitting. Upon engagement of the plug with the connector, interior surfaces of the prongs engage the exterior of tube extension collar 56. A fourth wire 71 is mounted to the interior of the member lower end so as to facilitate an electrical connection between the contact prongs and tube extension 55.

The body and insert are constructed preferably of an electrically insulating material, e.g., plastic or the like. The first and third inserts, on the other hand, are preferably constructed of a suitable electrically conductive material such as metal or the like. Although each insert has been described as fitting or being secured to either the body or another insert in a particular manner, it is understood that any means could be utilized given consideration to the purpose for which it is intended.

Clip 50 serves a dual function in that it both secures the connector assembly to the stem and holds the plug firmly to the connector. The clip has a hollow cylindrical body 70 with a pair of opposing notches 72 in one end and opposing teeth 73, 74 in the other end. Upon aligning and engaging the teeth with notches 75 in the connector housing lower end, rotation of the connector inside the stem is prevented.

The clip also has radial extensions 77, 78 formed on opposing sides thereof. The extensions are suitably positioned for engaging holes 79 in the lower tubular members. After positioning the connector inside the lower tubular member and against the stops, the clip is moved into the member until it comes into contact with the connector, the teeth and notches engaging one another. The clip then snaps into the holes and firmly holds the connector assembly in place.

Once the clip and connector are securely mounted inside the lower member of one stem module, the plug and first end of another stem module are inserted into the lower end of the one stem and are moved through passageway 29 until the plug meets and engages the connector. In particular, the tube extension engages the contact prongs of the third insert and the conductor tube contact collar engages the first insert prongs so as to create an electrical connection therebetween. As the plug and connector become engaged, detents 80 in the clip snap over the tapered collar of the plug housing, the detents resting in the adjacent sloped portion 38. In this manner, the clip secures the plug to the connector.

The in-line connector is advantageous in permitting electrical connections between a series of stem modules to be joined end to end at will so as to form a modular stem system. This system, consequently, may be modified to accommodate any display or other lighting requirements. For example, stem modules may be readily connected and disconnected depending upon the setting, e.g., the ceiling height, and the item or region to be illuminated.

The connector is also advantageous in providing alternating layers of insulative and conductive components and in using an insulative housing. Also, the two wire/connector system provides a safe connection should transformer failure or a fire occur. This is because the conductor elements are safely housed within the stem and are separated from one another rather than being exposed and subject to shorting.

As shown in FIG. 1, the lower end of the stem system mounts a light source, for example, a lamp 84. The lamp includes a cylindrical housing 85 with a cone-like reflector 86 extending from one end and a light source 87, for example, a light bulb, is detachably mounted to the housing and inside the cone. The housing is pivotally mounted to the stem lower end and has a handle 88 extending therefrom for adjusting the direction of the light produced.

The upper end of the stem system is attached to ceiling mount 91 such that the lamp and stem system hang vertically from the ceiling. Ceiling mount 91 houses a cylindrical receptacle having a clip similar to that of clip 50. The plug at the upper end of stem 20 is inserted into the receptacle of the mount, the plug engaging the clip in a similar fashion to that of clip 50. In this manner, the stem system is affixed to and suspended from the ceiling.

The apparatus of the present invention may be constructed of a variety of different materials. However, when selecting the materials to be used one should keep in mind the stresses to which the apparatus will be subjected during use. For example, although the assembly has been depicted as being made of steel or the like, it is understood that any material or combination of materials can be utilized giving consideration to the purpose for which the present invention is intended.

The above described arrangement methodology is merely illustrative of the principals of the present invention. Numerous modifications and adaptations thereof will be readily apparent to those skilled in the art without departing from the spirit and scope of the present invention. For example, although the present invention has been shown and described as being suspended from the ceiling in a vertical orientation, it is understood that any orientation could be utilized, e.g., perpendicular suspension from a vertical wall could be utilized.

What is claimed is:

1. A modular stem system for lighting apparatus comprising:

hollow stems, each having first and second ends;

a connector plug mounted at each first end;

a connector receptacle adjacent to each second end, the receptacle being configured for receiving the plug of another stem so as to permit connection of the stems end to end;

at least one stem having a flexible joint so as to permit flexure of the stem upon the application of lateral forces to the stem system;

means for dually securing each receptacle to the respective stem and each plug to the respective receptacle so as to facilitate connection of the stems end to end; and a light source adjacent to the second end of the lowermost stem;

each joint having two members, each member having a hollowed portion and an end configured for cooperation with the corresponding end of another member so as to allow pivotal movement about the ends;

a resilient member extending between and into the hollowed members for urging together their corresponding ends; and a sleeve extending between and into the hollowed members so as to protect the resilient member.

2. A modular stem system for lighting apparatus comprising:

hollow stems, each having first and second ends;

a connector plug mounted at each first end;

a connector receptacle adjacent to each second end, the receptacle being configured for receiving the plug of another stem so as to permit connection of the stems end to end;

at least one stem having a flexible joint so as to permit flexure of the stem upon the application of lateral forces to the stem system; and means for dually securing each receptacle to the respective stem and each plug to the respective receptacle so as to facilitate connection of the stems end to end;

each joint having two members, each member having a hollowed portion and an end configured for cooperation with the corresponding end of another member so as to alow pivotal movement about the ends;

a resilient member extending between and into the hollowed members for urging together their corresponding ends; and a sleeve extending between and into the hollowed members so as to protect the resilient member.

3. A flexible joint for lighting apparatus comprising:

two members, each having a hollowed portion and an end configured for cooperation with the corresponding end of another member so as to allow pivotal movement about the ends, a resilient member extending between and into the hollowed members for urging together their corresponding ends, a sleeve extending between and into the hollowed members so as to protect the resilient member, and means for securing the resilient member to each of the hollowed members such that the resilient member enables pivotal movement of the hollowed members about the ends between starting and flexed positions.

4. The flexible joint set forth in claim 3 wherein the resilient member comprises a spring.

5. A flexible joint for lighting apparatus comprising:

two members, each having a hollowed portion and an end configured for cooperation with the corresponding end of the other member so as to allow pivotal movement about the ends, a resilient member extending between the hollowed members upon cooperation of the corresponding ends, the resilient member comprising a spring, a sleeve extending between the hollowed members upon their cooperation so as to protect the resilient member, and means for securing the resilient member to each of the hollowed members such that the resilient member enables pivotal movement of the hollowed members about the ends between starting and flexed positions, the securing means comprising hooks on the spring configured so as to directly engage each hollowed member.

6. The flexible joint set forth in claim 5 wherein the hollowed members further comprise perforations configured so as to receive the hooks for securement of the spring across the ends.

7. A flexible joint for lighting apparatus comprising:

two members, each having a hollowed portion and an end configured for cooperation with the corresponding end of the other member so as to allow pivotal movement about the ends, a spring extending between the hollowed members upon cooperation of the corresponding ends, means for securing the spring to each of the hollowed members, therby enabling pivotal movement of the hollowed members about the ends between starting and flexed positions, the securing means comprising hooks on the spring configured so as to engage each hollowed member, the securing means further comprising perforations in the hollowed members configured so as to receive the hooks for securement of the spring across the ends.

8. A method for joining members for lighting applications, which comprises the steps of:

(a) aligning a pair of the members end to end;

(b) positioning a sleeve over a resilient member;

(c) positioning the resilient member and sleeve in hollowed portions of the pair of members such that they extend between and into the hollowed members; and (d) securing directly the resilient member to each hollowed member so as to permit the hollowed members to pivot about the ends.

9. A stem for lighting apparatus comprising:

a hollowed member having a joint along the length thereof, the member pivoting about the joint between starting and flexed positions;

a resilient member mounted across the joint such that upon pivoting of the hollowed member into a flexed position, the resilient member causes the hollowed member to return to the starting position;

means for securing the resilient member across the joint so as to enable pivotal movement of the hollowed member; and a sleeve extending across and into the joint of the hollowed member so as to protect the resilient member.

* * * * *